US007287493B2

(12) United States Patent
Buck

(10) Patent No.: US 7,287,493 B2
(45) Date of Patent: Oct. 30, 2007

(54) INTERNAL COMBUSTION ENGINE WITH HYBRID COOLING SYSTEM

(75) Inventor: Kenneth M. Buck, Winterville, NC (US)

(73) Assignee: Buck Supply Co., Inc., Winterville, NC (US)

( * ) Notice: Subject to any disclaimer, the term of this patent is extended or adjusted under 35 U.S.C. 154(b) by 14 days.

(21) Appl. No.: 11/163,945

(22) Filed: Nov. 4, 2005

(65) Prior Publication Data

US 2006/0096555 A1 May 11, 2006

Related U.S. Application Data

(60) Provisional application No. 60/658,078, filed on Mar. 3, 2005, provisional application No. 60/658,079, filed on Mar. 3, 2005, provisional application No. 60/626,622, filed on Nov. 10, 2004, provisional application No. 60/626,623, filed on Nov. 10, 2004.

(51) Int. Cl.
*F01P 3/00* (2006.01)
*F02B 75/18* (2006.01)

(52) U.S. Cl. ..... 123/41.01; 123/41.28; 123/41.29; 123/41.74

(58) Field of Classification Search ..... 123/197.4, 123/195 H, 41.28, 41.29, 41.74; 60/320, 60/321

See application file for complete search history.

(56) References Cited

U.S. PATENT DOCUMENTS 632,950 A 9/1899 Spence
898,678 A 9/1908 Piggins
900,083 A 10/1908 Clark
904,562 A 11/1908 Rathbun
1,145,995 A 7/1915 Johnson
1,163,671 A 12/1915 Kraus
1,260,847 A 3/1918 Winton
1,408,179 A 2/1922 Du Pont
1,622,965 A 3/1927 Napier et al.
1,814,676 A 7/1931 Estep
1,850,246 A 3/1932 Simmen
1,906,765 A 5/1933 Purkey
2,199,423 A * 5/1940 Taylor ..... 92/147
2,423,602 A 7/1947 Magdeburger
2,455,493 A 12/1948 Jacobs
2,491,630 A 12/1949 Voorhies
2,712,483 A 7/1955 Ciaccia
2,858,667 A 11/1958 Reske (Continued)

OTHER PUBLICATIONS

Lee, Yi-Kuen; Yi, Ui-Cong; Tseng, Fan-Gang; Kim, Chang-Jin "CJ"; Ho, Chih-Ming, "Fuel Injection by a Thermal Microinjector", Mechanical and Aerospace Engineering Department; University of California, Los Angeles, CA; cjkim@seas.ucla.edu.

(Continued)

*Primary Examiner*—Stephen K. Cronin
*Assistant Examiner*—Hyder Ali
(74) *Attorney, Agent, or Firm*—Jerome R. Drouillard; Dickinson Wright PLLC

(57) ABSTRACT

An internal combustion engine that includes individually-cooled cylinder assemblies. Direct raw-water cooling is provided for the engine's intercooler, oil cooler, and heat exchanger, which is used for the purpose of cooling a fresh water coolant circulating individually through each of the engines' separate cylinders.

19 Claims, 10 Drawing Sheets

U.S. PATENT DOCUMENTS 3,136,306 A 6/1964 Kamm
3,169,365 A 2/1965 Benjamen
3,398,653 A 8/1968 Foster
3,946,697 A 3/1976 Hackbarth et al.
4,015,908 A 4/1977 Ashley
4,029,071 A 6/1977 Saito et al.
4,033,016 A 7/1977 Mayer
4,041,919 A 8/1977 Bonin
4,068,612 A 1/1978 Meiners
4,133,284 A 1/1979 Holcroft
4,179,884 A 12/1979 Koeslin
4,187,678 A 2/1980 Herenius
4,214,443 A 7/1980 Herenius
4,220,121 A 9/1980 Maggiorana
4,268,042 A 5/1981 Borlan
4,286,931 A 9/1981 Hafele et al.
4,306,614 A 12/1981 Maggiorana
4,308,834 A 1/1982 Eheim
4,348,991 A 9/1982 Stang et al.
4,385,594 A 5/1983 Hauser, Jr.
4,437,444 A 3/1984 Yasuhara
4,449,503 A 5/1984 Luscomb
4,459,945 A 7/1984 Chatfield
4,490,098 A 12/1984 Freudenschuss et al.
4,497,298 A 2/1985 Ament
4,534,241 A 8/1985 Remmerfelt et al.
4,535,592 A 8/1985 Zinsmeyer
4,539,956 A 9/1985 Hengel et al.
4,562,697 A 1/1986 Lawson
4,565,175 A 1/1986 Kaye
4,596,179 A 6/1986 Bando
4,621,594 A 11/1986 Kubis
4,622,864 A 11/1986 Fetouh
4,699,112 A 10/1987 Filippi et al.
4,700,047 A 10/1987 Crossett et al.
4,704,949 A 11/1987 Foster
4,711,088 A 12/1987 Berchem et al.
4,712,985 A 12/1987 Wakasa et al.
4,742,801 A 5/1988 Kelgard
4,759,181 A 7/1988 Biritz
4,763,619 A 8/1988 Eitel
4,790,731 A 12/1988 Freudenschuss
4,807,577 A 2/1989 Koutsoupidis
4,819,606 A 4/1989 Kawano
4,861,243 A 8/1989 Wade
4,884,542 A 12/1989 Konrath et al.
4,913,115 A 4/1990 Konrath et al.
4,928,656 A 5/1990 Ausiello
4,961,404 A 10/1990 Itakura et al.
4,968,220 A 11/1990 Filippi et al.
5,004,042 A 4/1991 McMorries, IV et al.
5,014,572 A 5/1991 Swars
5,060,606 A 10/1991 Hubbard
5,072,706 A 12/1991 Eblen et al.
5,095,861 A 3/1992 Dove, Jr.
RE33,870 E 4/1992 Fittro et al.
5,115,771 A 5/1992 Ozawa
5,148,675 A 9/1992 Inman
5,197,188 A 3/1993 Maus et al.
5,209,208 A 5/1993 Siebert et al.
5,303,468 A 4/1994 Cieszkiewicz et al.
5,316,079 A 5/1994 Hedeen
5,394,854 A 3/1995 Edmaier et al.
5,415,147 A 5/1995 Nagle et al.
5,433,178 A 7/1995 Urmaza
5,463,867 A 11/1995 Ruetz
5,551,234 A 9/1996 Ochoizki
5,577,470 A 11/1996 Leydorf, Jr. et al.
5,706,675 A 1/1998 Manikowski, Jr.
5,730,093 A 3/1998 Calka et al.
5,732,665 A 3/1998 Morrison
5,746,270 A 5/1998 Schroeder et al.
5,813,372 A 9/1998 Manthey
5,832,991 A 11/1998 Cesaroni
6,006,730 A 12/1999 Rutke et al.
6,009,850 A 1/2000 DeLuca
6,016,790 A 1/2000 Makino et al.
6,027,312 A 2/2000 Djordjevic
6,073,862 A 6/2000 Touchette et al.
6,098,576 A 8/2000 Nowak, Jr. et al.
6,116,026 A 9/2000 Freese
6,123,144 A 9/2000 Morman et al.
6,178,936 B1 1/2001 Kouchi et al.
6,182,643 B1 2/2001 Canopy
6,196,181 B1 3/2001 Pong
6,227,156 B1 5/2001 Autrey et al.
6,230,676 B1 5/2001 Pryba et al.
6,230,683 B1 5/2001 zur Loye et al.
6,237,554 B1 5/2001 Garrison
6,244,231 B1 6/2001 Kouchi et al.
6,293,335 B1 9/2001 Tawney et al.
6,343,576 B1 2/2002 Ogata et al.
6,347,618 B1 2/2002 Klem
6,357,401 B1 3/2002 Moriyama et al.
6,360,532 B2 3/2002 Strahle et al.
6,360,728 B1 3/2002 Sturman
6,378,299 B1 4/2002 Schlehuber
6,378,396 B1 4/2002 Reinhardt et al.
6,408,803 B1 6/2002 Atkins
6,415,754 B1 7/2002 Hirano et al.
6,457,442 B1 10/2002 Fuchs et al.
6,484,683 B2 11/2002 Zielke
6,604,515 B2 8/2003 Marsh et al.
6,640,773 B2 11/2003 Ancimer et al.
6,640,775 B2 11/2003 Itoyama et al.
6,651,618 B1 11/2003 Coleman et al.
6,672,989 B2 1/2004 Murata et al.
6,694,945 B2 2/2004 Kawaguchi et al.
6,698,509 B2 3/2004 Rong
6,725,815 B2 4/2004 Cannata
6,729,133 B1 5/2004 Sorter et al.
6,739,293 B2 5/2004 Turner et al.
6,748,906 B1 6/2004 White et al.
6,748,934 B2 6/2004 Natkin et al.
6,755,176 B2 6/2004 Takeuchi et al.
6,758,193 B1 7/2004 Kincaid
6,823,833 B2 11/2004 Ismailov
6,840,209 B2 1/2005 Shimazaki
6,840,211 B2 1/2005 Takahashi
6,840,219 B2 1/2005 Joos et al.
6,840,220 B2 1/2005 Yomogida et al.
6,845,747 B2 1/2005 Rasmussen et al.
6,845,754 B2 1/2005 Pecheny et al.
6,845,757 B2 1/2005 Strahberger et al.
6,941,914 B2 9/2005 Snyder et al.

OTHER PUBLICATIONS

Seatek 600-PLUS 6 Cylinder, Marine Diesel Engine; Feb. 10, 2005; http://boatdiesel.com/Engines/.

* cited by examiner

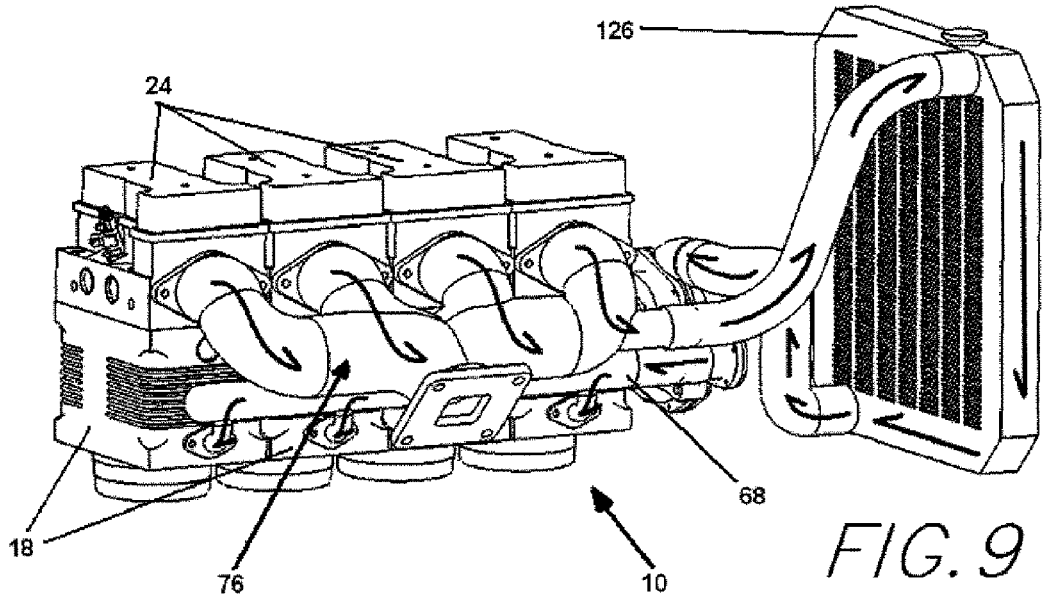
FIG. 9
FIG. 10
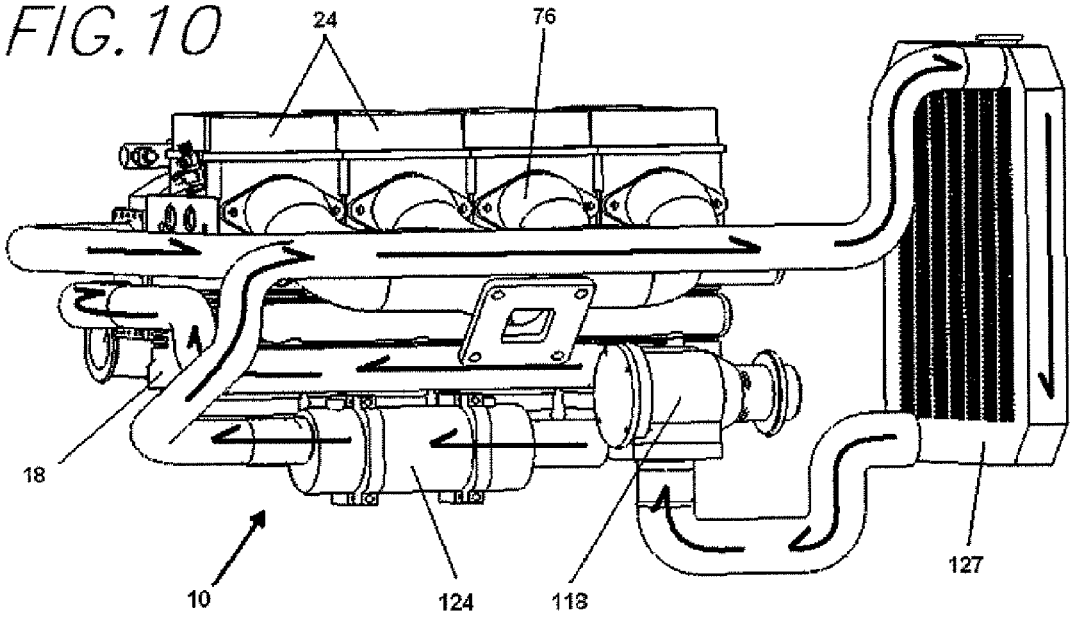

INTERNAL COMBUSTION ENGINE WITH HYBRID COOLING SYSTEM

RELATED APPLICATION(S)

The present application claims priority to U.S. Provisional Patent Applications 60/626,622 and 60/626,623, filed Nov. 10, 2004, and U.S. Provisional Patent Applications 60/658,078 and 60/658,079, filed Mar. 3, 2005, and is related to U.S. patent application Ser. No. 11/163,947 filed Nov. 4, 2005.

TECHNICAL FIELD

The present invention relates to an internal combustion engine ideally adapted for use as a marine engine and having direct raw water cooling of certain components, and fresh water cooling of other components. The present engine is thus said to have a "hybrid" cooling system, because both types of cooling are used. Also, as used herein, the term "direct" means that the flow of water moves from a source such as, in the case of a marine engine, a body of water in which a vessel is operating, and in the case of a vehicular engine, a flow of water directly from a radiator. This movement is direct because the water flows without any intervening use as a cooling medium. The present inventive engine provides significant advantages when operated in a high-boost turbocharged or supercharged mode.

BACKGROUND

The vast majority of multi-cylinder internal combustion engines sold today utilize a single cylinder block containing a plurality of cylinder bores. Unfortunately, if one of the cylinder bores becomes damaged to the point where it cannot be repaired by sleeving or by other means commonly used for such repairs, the entire cylinder block must be scrapped. And, even when an engine block can be repaired by boring and sleeving a damaged cylinder, the entire engine must generally be removed and taken to a shop for the repair. This renders the entire process very inconvenient and costly.

Another drawback characterizing conventional engines resides in the engines' cooling systems. Most engines use a cooling circuit in which water is drawn into a lower portion of the engine, particularly the cylinder block, and then allowed to flow along the length of the cylinder block, while a portion of the water flowing along the length of the cylinder block, and eventually, all of the water, flows upwardly through the cylinder head of the engine. Then, water flows along cooling passages formed within the cylinder head and out of the engine. A drawback of this type of cooling system resides in the fact that the coolant enters the cylinder block at a single point and exits at another single point; as a consequence, the coolant must travel a fairly long path through the engine. As a further consequence, the coolant may become quite hot and therefore unable to transfer as much heat as would be the case were the coolant to be introduced at a lower temperature and not forced to flow around the entire engine.

An engine according to the present invention solves the problems described above by providing a true modular construction for the power cylinders. In one embodiment, the cylinder carrier is itself modular. All of the present inventive engines utilize direct raw water cooling, including cooling of the engine's recirculating coolant. This superior cooling configuration is combined with individual fresh water cooling of each of the engines' cylinder assemblies. Each cylinder receives an individual flow of coolant which is flowing directly from a heat exchanger. In this manner, the present engines are ideally suited for charge air boosting to fairly high pressures, because the engines offer superior cooling capability as compared with prior art engines.

SUMMARY

A liquid-cooled internal combustion engine includes a plurality of cylinder assemblies mounted individually to a common cylinder carrier. Each cylinder assembly houses a single piston and has a cylinder portion with a cylinder bore, a cylinder head with at least one intake port, and at least one exhaust port, as well as at least one self-contained cooling passage. The present engine also includes a common-rail coolant inlet manifold for introducing an individual coolant flow to each of the self-contained cooling passages within the cylinder assemblies, and a exhaust manifold assembly mounted to each of the cylinder heads, with the exhaust manifold including a plurality of branch passages for receiving exhaust from each of the cylinder head exhaust ports. The exhaust manifold further includes a number of separate coolant intake passages for conducting coolant flowing from each of the self-contained cooling passages in the cylinder head about an exterior portion of a mating one of each of the branch passages.

The self-contained cooling passages in each cylinder assembly extend about the cylinder portion and cylinder head. The coolant is introduced by the coolant inlet manifold into each of the self-contained passages at a location proximate a lower portion of the cylinder portions, so that coolant is first permitted to flow about the cylinder portion, and then about the cylinder head, prior to being discharged into the exhaust manifold at a location proximate the exhaust port corresponding to the particular cylinder in question.

Coolant for the cylinders and cylinder head of the present engine is circulated by means of a primary water pump which circulates either fresh water, or a glycol and water solution, through the cylinder portions and then through the cylinder heads into the exhaust manifold. While in the exhaust manifold, a heat exchanger mounted within the manifold transfers heat from coolant flowing from the cylinder assemblies to raw water flowing through the exhaust manifold's heat exchanger.

In order to achieve excellent intercooling, a liquid-cooled charge air intercooler is furnished with raw water directly by a raw water pump. Similarly, a liquid-cooled engine oil cooler is furnished with raw water directly by the raw water pump. Raw water is also furnished directly to the previously described heat exchanger situated within the exhaust manifold.

A secondary fluid cooler located downstream from the intercooler transfers heat from a secondary fluid, such as hydraulic fluid, transmission fluid, or fuel, to raw water flowing from the intercooler.

A turbocharger ideally mounted on an engine according to the present invention includes a cooling jacket for receiving raw water flowing from the oil cooler.

According to another aspect of the present invention, a method for cooling a multi-cylinder internal combustion engine includes the steps of cooling a number of cylinder assemblies by providing an individual flow of fresh water to each of a corresponding number of discrete cooling passages. A separate, discrete cooling passage is routed to, and through, each of the cylinder assemblies. The present method also includes the step of extracting heat from the fresh water flowing from the cylinder assemblies by means of a direct raw water cooled heat exchanger located within the engine's exhaust manifold. The present method also includes the step of extracting heat from a charge air intercooler by providing a direct raw water flow to the intercooler. Finally, the present method may include the step of extracting heat from lubricating oil flowing through the engine by means of a heat exchanger cooled by direct raw water flow.

According to another aspect of the present invention, a cylinder carrier includes a plurality of cylinder mounting modules and a plurality of main bearing bulkheads interposed between and interconnecting adjacent ones of the cylinder mounting modules. A crankshaft is mounted to the main bearing bulkheads. The mechanical strength of the cylinder carrier is enhanced by structural rails, extending longitudinally along the periphery of the cylinder carrier, parallel to the crankshaft's centerline. These structural rails extend vertically and downwardly from a position above the centerline of the crankshaft, to an oil pan.

Each of the cylinder mounting modules preferably comprises a light alloy casting, with each of the main bearing bulkheads preferably comprising a ferrous body. For example, cylinder mounting modules may be formed as aluminum castings, with the main bearing bulkheads being grey or nodular iron, cast steel or other ferrous compositions. As yet another alternative, not only the cylinder mounting modules, but also the main bearing bulkheads may be fabricated from a light alloy.

The present engine further includes a single camshaft extending parallel to the crankshaft centerline. The camshaft operates at least one intake valve and at least one exhaust valve for each of the individual cylinder heads. The camshaft operates the valves by means of at least two rocker shafts extending across an upper portion of each of the cylinder heads in a direction generally perpendicular to the crankshaft centerline.

According to another aspect of the present invention, a method for removing and reinstalling an individual cylinder assembly of an internal combustion engine includes the steps of draining coolant from the engine and removing a plurality of fasteners extending from a cylinder carrier upwardly through a cylinder portion and into a cylinder head. Thereafter, the cylinder head and cylinder portion are lifted from the engine and a wrist pin is shifted within the piston so as to allow the piston to be removed from the connecting rod. Then, a new piston and wrist pin are installed upon the connecting rod and a new cylinder portion is installed upon the piston by sliding a piston ring compression zone of the cylinder portion over a plurality of piston rings carried upon the piston. Thereafter, the new cylinder portion is seated upon a pilot diameter formed in the cylinder carrier and the cylinder head is mounted upon the cylinder portion. Preferably, each of the cylinder portions has a cylinder sleeve pressed in place in the cylinder portion.

According to another aspect of the present invention, a method for replacing crankshaft main bearing inserts in a reciprocating internal combustion engine includes the steps of removing an oil pan mounted to structural rails of the bottom of the engine's cylinder carrier, and then removing at least one of the structural rails extending longitudinally along a portion of a cylinder carrier parallel to the crankshaft's centerline. The structural rail also extends vertically from a position above the centerline of the crankshaft to the oil pan. After the structural rail and oil pan are removed, a number of main bearing caps will be removed serially from the cylinder carrier while replacing the main bearing inserts associated with each of the bearing caps. Thereafter, the engine is completed by reinstalling the previously removed structural rail and the oil pan.

It is an advantage of an engine according to the present invention that very high turbocharger or supercharger boosting rates are sustainable without risk of engine damage because the use of separate and direct raw water cooling of the engine lubricant, engine fresh water coolant, and charge air intercooler, coupled with individual cylinder coolant supply and the exceedingly short coolant flow paths through the engine, assure that excellent heat rejection is achieved.

It is another advantage of an engine system according to the present invention that a single cylinder may be repaired without the necessity of disassembling the remaining portions of the engine. This is particularly important for engines operated at a very high specific output, such as engines installed in offshore racing vessels, because for a variety of reasons, it frequently happens that only a single cylinder will fail. Unfortunately, with conventional marine engines, such failure often necessitates disassembly of the boat to remove an engine with a single failed cylinder. This problem is obviated by an engine constructed according to the present invention.

It is yet another advantage of an engine system according to the present invention that the modularity of the engine allows engines to be produced with multiple numbers of cylinders such as two, three, four, six, eight, or more, using structurally identical cylinder assemblies, cylinder mounting modules, and main bearing bulkheads.

It is yet a further advantage of an engine and method according to the present invention that an engine rebuild may be accomplished without the need to re-machine any component of the engine other than, in certain cases, the crankshaft.

The present inventive engine may be operated as either a naturally aspirated gasoline or diesel engine, or as a turbocharged or supercharged gasoline or diesel engine. Operation of the present engine may be enhanced with nitrous oxide injection.

Other advantages, as well as objects and features of the present invention, will become apparent to the reader of this specification.

BRIEF DESCRIPTION OF THE DRAWINGS

FIG. 9 illustrates a primary, or fresh water, cooling path for an engine in a non-marine engine application and having a radiator.

FIG. 10 is similar to FIG. 9 but shows the secondary cooling system path of a non-marine engine application according to the present invention and also having a radiator.

DETAILED DESCRIPTION OF THE PREFERRED EMBODIMENTS

Figure 1:
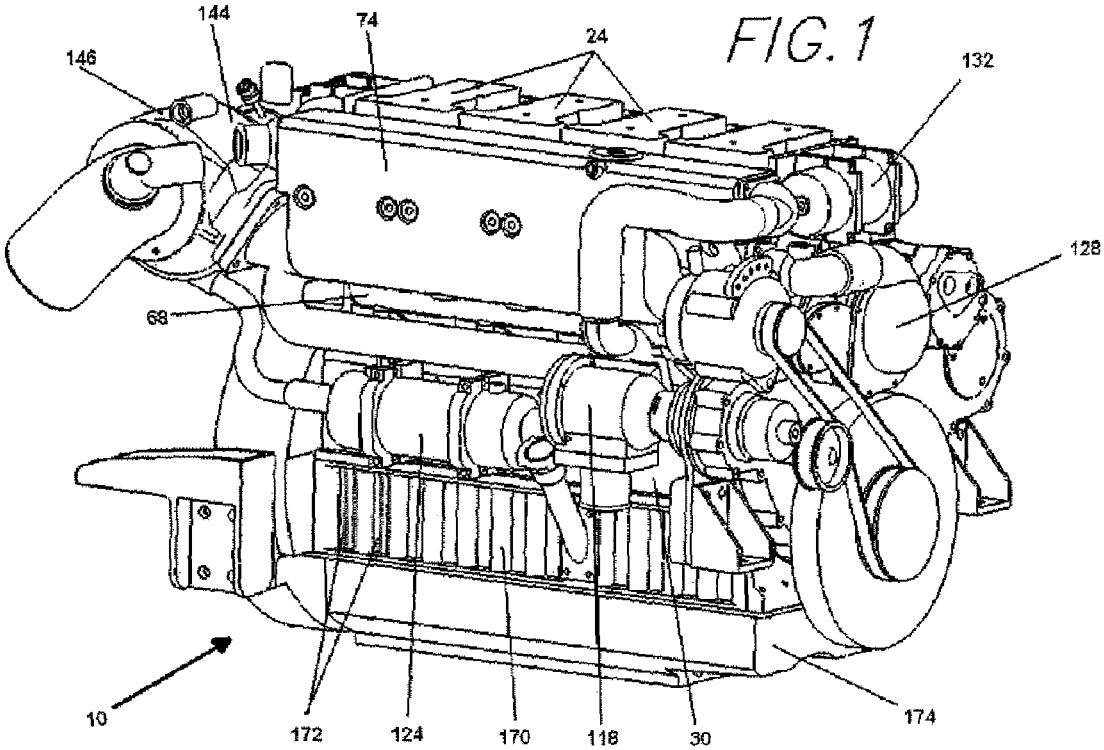
FIG. 1 is a perspective view of an engine according to the present invention.
Figure 2:
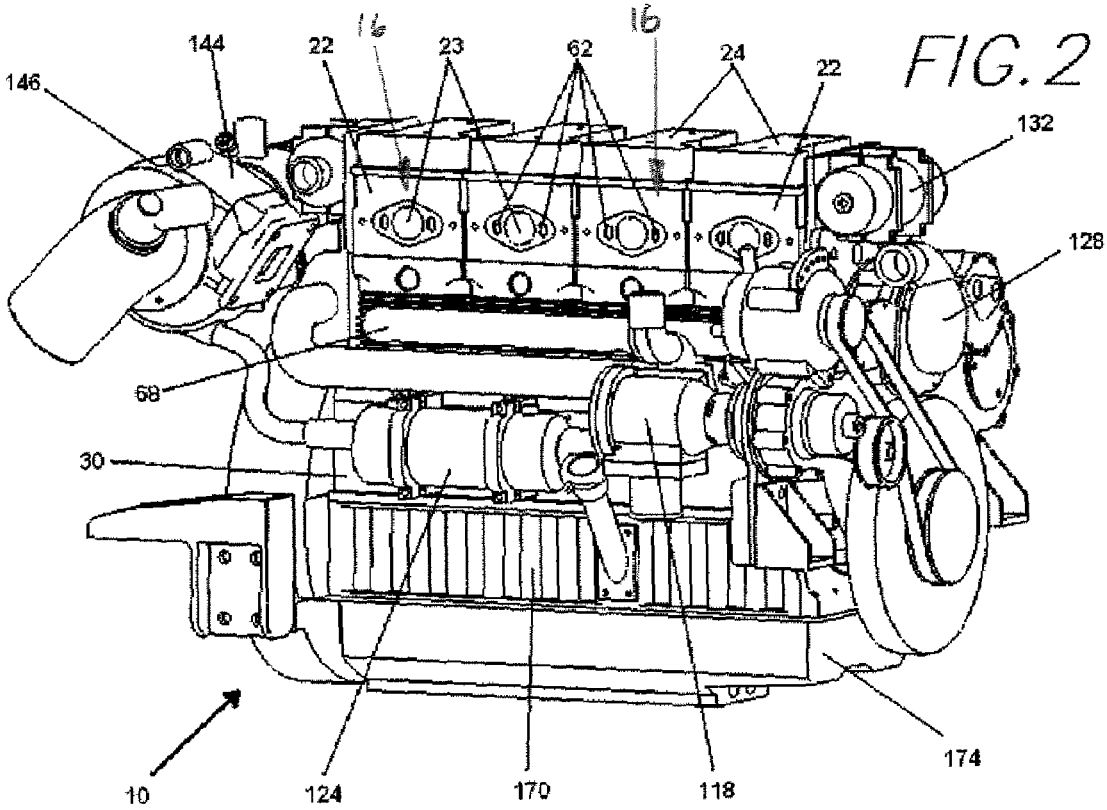
FIG. 2 is similar to FIG. 1, but shows the engine of FIG. 1 with the exhaust manifold assembly removed.
Figure 3:
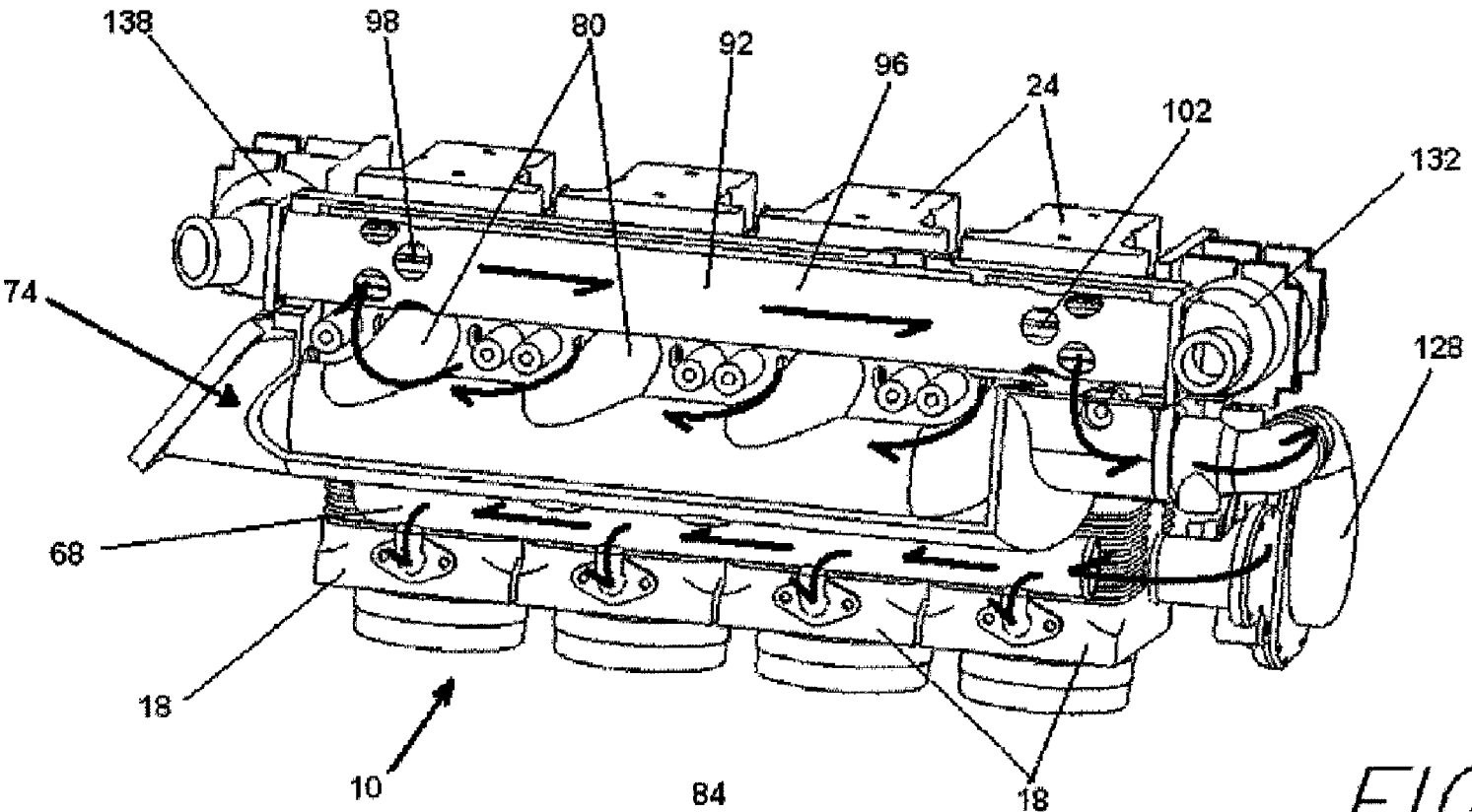
FIG. 3 illustrates various flow paths for the primary or fresh water, cooling system of an engine according to the present invention.

As shown in FIG. 1, engine 10 is an inline engine which is turbocharged and which has a liquid-cooled exhaust manifold for marine use. A primary water pump, 128, circulates fresh water through exhaust manifold assembly 74, as well as through the cylinder assemblies 16, which are shown more clearly in FIGS. 2, 6, and 13. As used herein, the term "fresh water" has the conventional meaning: i.e., coolant which is not extracted from a body of water upon which a vessel is being operated, but rather is fresh water or glycol solution cooled by a heat exchanger.

Figure 6:
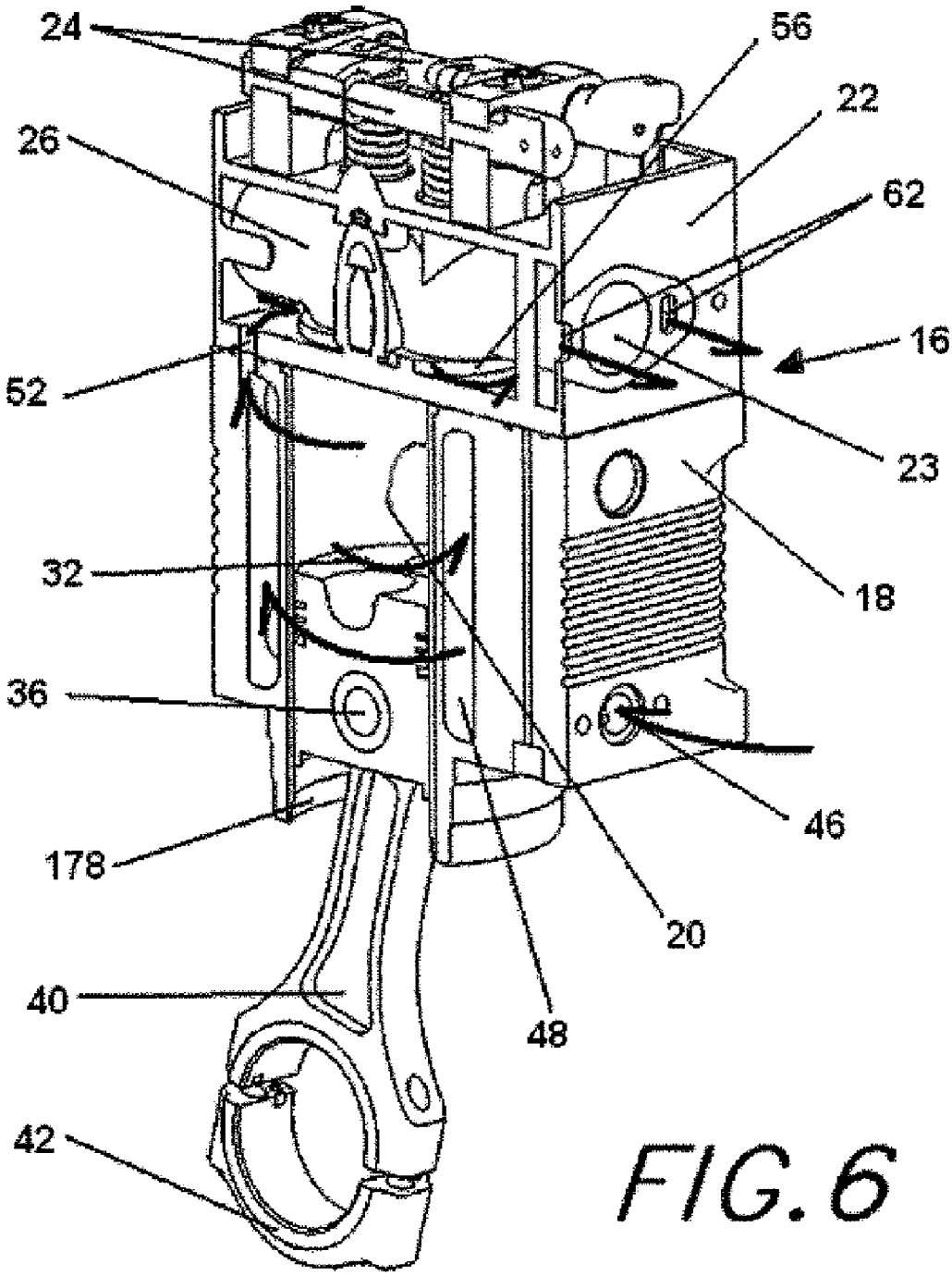
FIG. 6 is a cutaway perspective view of a cylinder assembly according to the present invention.

Each cylinder assembly 16, which is shown freestanding in FIG. 6, includes cylinder portion 18, having a cylinder bore 20 which is normally fitted with a honed iron sleeve. Cylinder portion 18 is preferably cast from a light alloy such as an aluminum or magnesium alloy. Alternatively, other metals such as iron could be employed for forming cylinder portion 18. Cylinder head 22 is mounted to an upper portion of cylinder portion 18. Cylinder head 22, as shown in FIG. 6, also includes intake port 26 and exhaust port 23.

Figure 13:
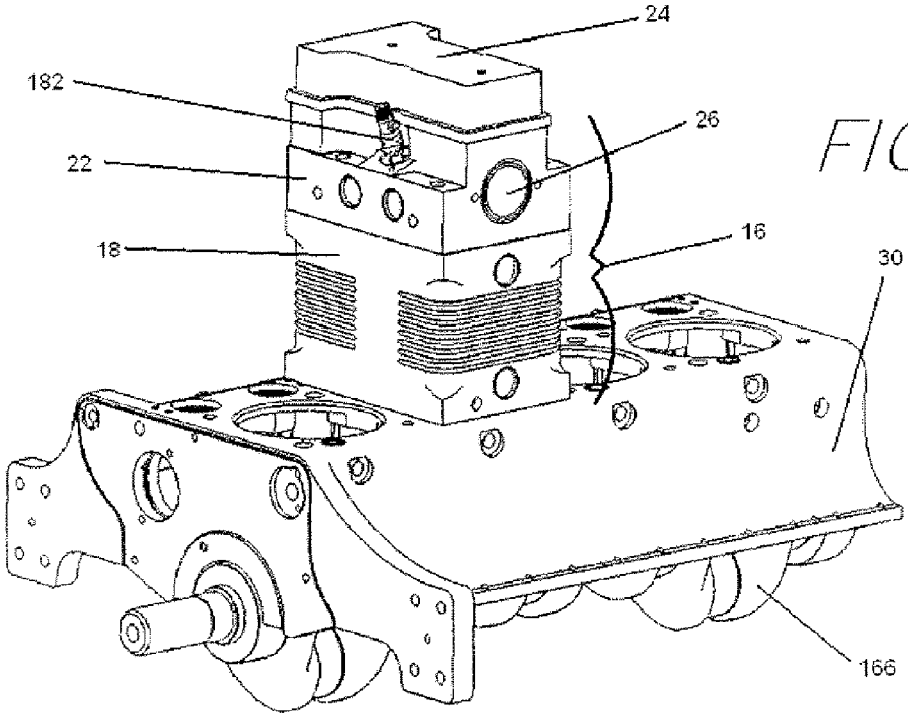
FIG. 13 illustrates a unitary cylinder carrier according to one aspect of the present invention having a cylinder assembly 16 mounted thereto.

FIG. 13 depicts a fuel injector, 182, which may comprise either a diesel injector, a gasoline injector, a natural gas injector, a nitrous oxide injector, or yet other types of fuel injectors known to those skilled in the art and suggested by this disclosure. At least one injector 182 is mounted to each of cylinder heads 22.

FIGS. 1, 2, 3, and 9 illustrate coolant supply manifold 68, which functions as a common rail to provide an individual coolant flow to self-contained cooling passages located within cylinder assembly 16 (FIG. 13). In essence, each of cylinder assemblies 16 is provided with coolant which has not flowed through other cylinder assemblies. As shown in FIG. 6, coolant enters cylinder assembly 16 through coolant inlet port 46 and then travels through water jacket 48 located about cylinder bore 20. After circulating about water jacket 48, coolant flows through transfer ports 52 and up into transverse cooling passage 56 formed within cylinder head 22. After having flowed through transverse cooling passage 56, coolant exits cylinder head 22 by means of coolant outlet ports 62. These coolant outlet ports are shown in FIG. 6, as well as in FIG. 2.

Figure 4A:
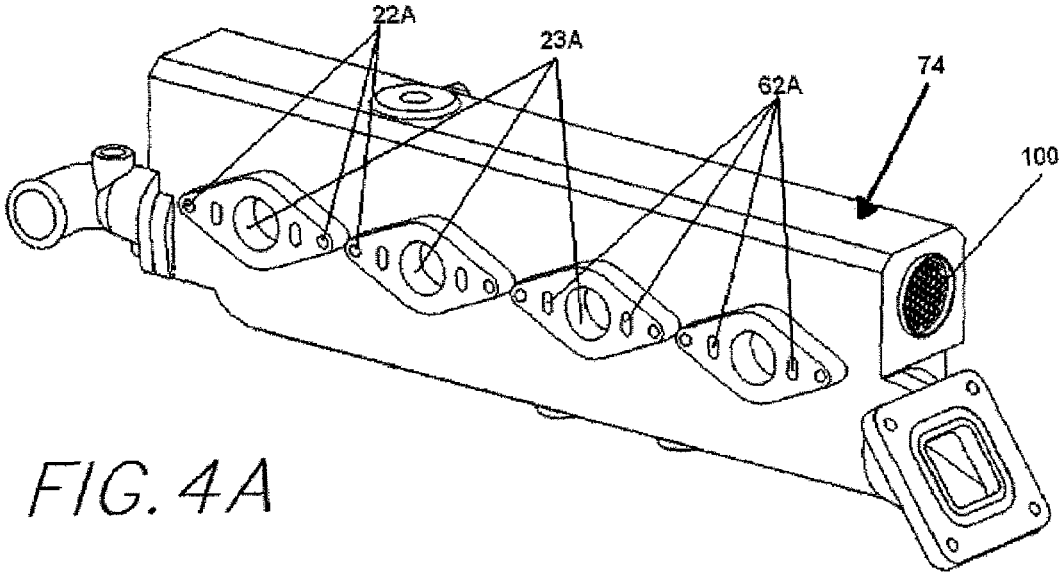
FIGS. 4A and 4B show an exhaust manifold according to the present invention.
Figure 4B:
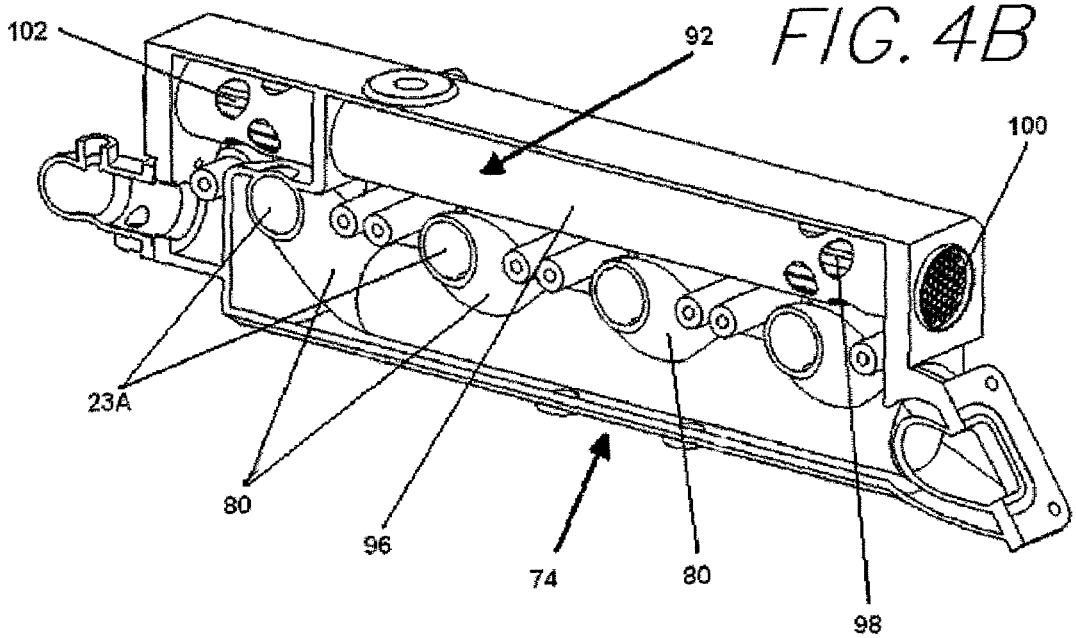

Fresh water coolant flowing from outlet ports 62 of each of cylinder heads 22 flows through coolant intake passages or ports 62A formed in exhaust manifold 74 (FIG. 4A). Then, coolant flows around exhaust branch passages 80 and then through inlet ports 98 and inside shell 96 of coolant heat exchanger 92 (FIG. 4B). After entering shell 96, coolant flows around the tubes of tube bundle 100 contained within coolant heat exchanger 92. Then, coolant exits heat exchanger 92 by flowing through outlet ports 102 formed in shell 96. Leaving heat exchanger 92, the fresh water coolant recirculates through primary water pump 128 and back through coolant supply manifold 68 and into cylinder assemblies 16.

Figure 7:
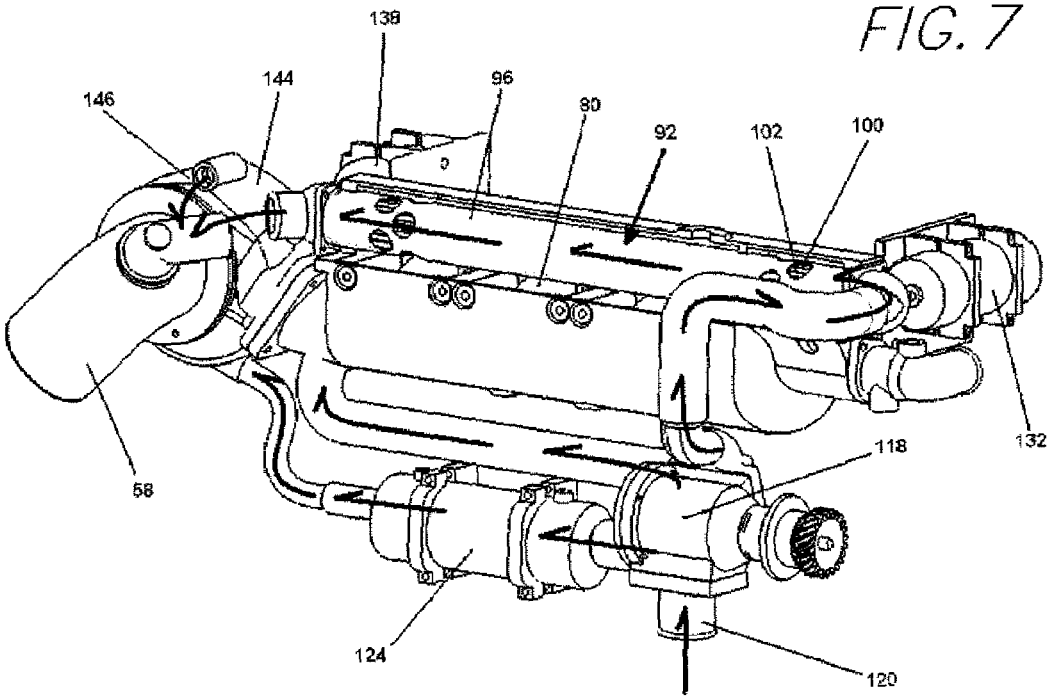
FIG. 7 is similar to FIG. 3 but shows additional aspects of a raw water cooling system and flow paths according to the present invention.

Tube bundle 100 is cooled by means of a direct raw water flow provided by raw water pump 118 which is shown in FIGS. 1, 2, 7, and 10. Raw water is furnished to one end of tube bundle 100 located at the front of the engine, as shown in FIG. 7, and having traversed the length of tube bundle 100 and with the raw water traveling inside the numerous small tubes of the tube bundle, the raw water exits and flows into exhaust elbow 58. Because raw water is provided directly to coolant heat exchanger 92, high efficiency cooling is achieved, so as to allow high boosting rates with the present engine.

Turning now to FIG. 7, raw water pump 118 has inlet 120 which picks up raw water at ambient temperature from a lake, river, or ocean. The flow is immediately split into three separate flows. A first single flow passes through the engine oil cooler 124 and then to turbocharger cooling jacket 146, which surrounds a portion of turbocharger 144. After flowing through turbocharger cooling jacket 146, the water flows into exhaust elbow 58. A second and separate flow of the raw water from raw water pump 118 flows, as previously described, through the engine's fresh water cooling heat exchanging system 92.

Figure 8:
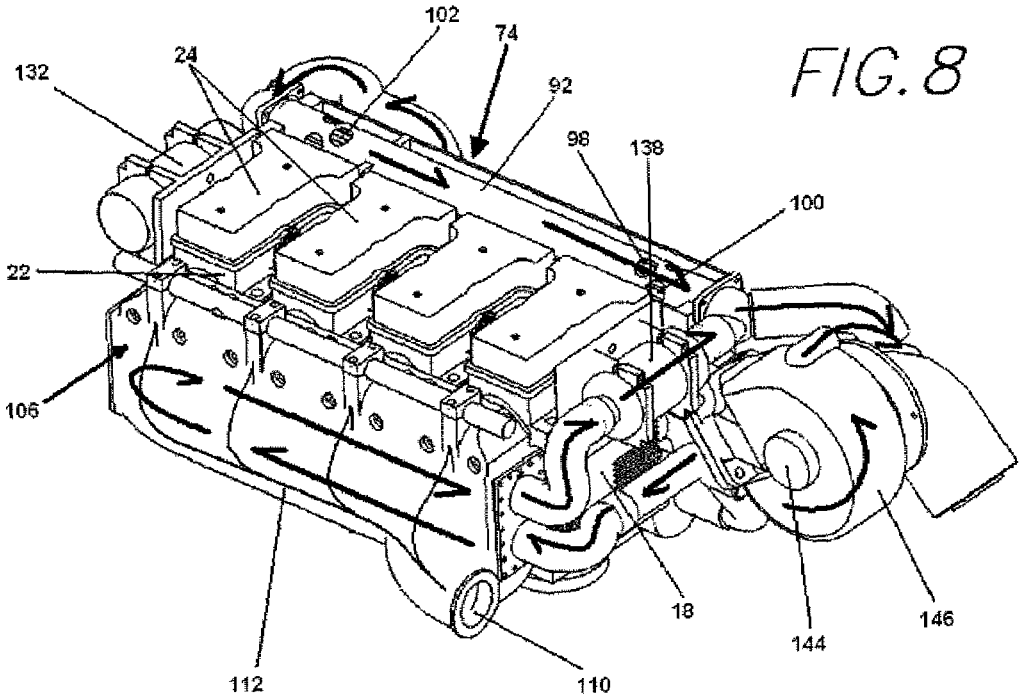
FIG. 8 illustrates the raw water flow path through an intercooler and heat exchanger of an engine according to the present invention.

The third separate flow of raw water from the raw water pump 118 flows through intercooler coil 112 (not visible), located inside intake manifold 106 which is shown in FIG. 8 and receives direct raw water flow from pump 118. Air arriving at intake manifold 106 passes from turbocharger 144 into air inlet 110 and then flows upwardly through intake manifold 106 and over a heat exchanger coil within intercooler 112 and into intake port 26 of cylinder head 22 visible on FIG. 13. Because raw water is provided directly to intercooler 112, the raw water is at a much colder temperature than would otherwise be the case were the water to be used to cool some other part of the engine, such as the engine oil cooler, before entering intercooler 112. This is not the case with known engines.

Raw water leaving the intercooler 112 passes through secondary fluid cooler 138, which is shown in FIG. 8. Cooler 138 may be used for the purpose of extracting heat from transmission fluid, or other types of fluids used in a vehicle or boat having the present engine. Coolant expansion tank 132 is mounted at the opposite end of the engine from secondary fluid cooler 138. Expansion tank 132 accounts for the fact that known engine coolants generally have a positive coefficient of thermal expansion. Expansion tank 132 allows for this expansion without the necessity of admitting air into the cooling system.

Figure 5A:
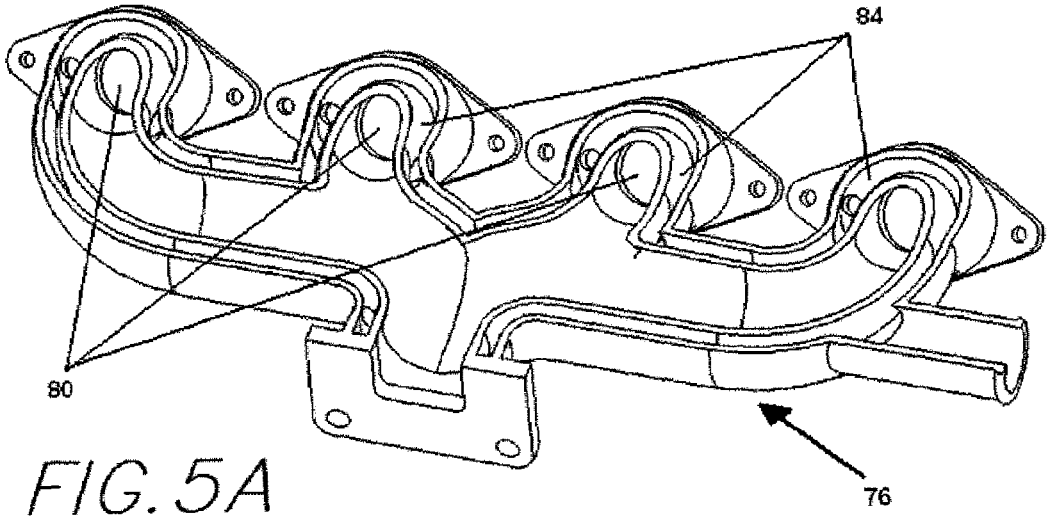
FIGS. 5A and 5B illustrates a liquid-cooled exhaust manifold suitable for use with a non-marine engine according to the present invention.
Figure 5B:
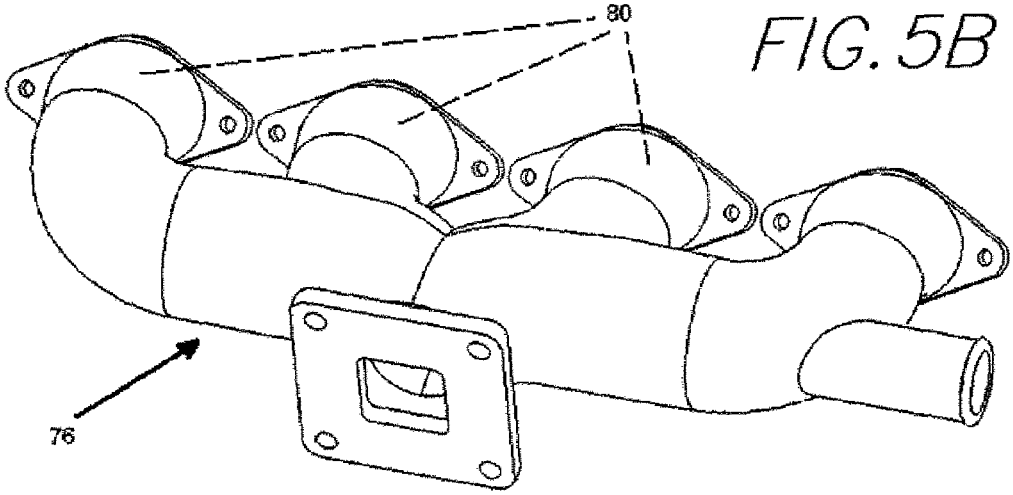

FIGS. 5A and 5B illustrate an exhaust manifold, 76, suitable for use with a non-marine variant of the present engine. The manifold 76 of FIG. 5 is, however, liquid-cooled and the generally annular discharge coolant passages 84, which are also used in the manifold of FIG. 4, are readily ascertainable in FIG. 5A.

The manifold of FIG. 5A may be combined with the radiator illustrated in FIG. 9. For the sake of clarity, the primary fresh water cooling system shown in FIG. 9 is separated from the secondary cooling system shown in FIG. 10. In reality, both systems rely on the rejection of heat to the ambient air, which radiators 126 and 127 provide. Note in FIG. 10, however, that a salient feature of the present invention resides in the fact that cooled water from radiator 127, is used for the purpose of providing water to the cooling circuits furnished with raw water in the marine embodiments described earlier. Also, in a vehicular system the two cooling circuits would likely be combined into one, with the use of a single sufficiently large radiator and a single sufficiently large pump, with a split pump discharge providing the coldest possible coolant flow to the engine coolant supply manifold, oil cooler, and intercooler. Cooling of the turbocharger is not normally required in a vehicular application.

Figure 14:
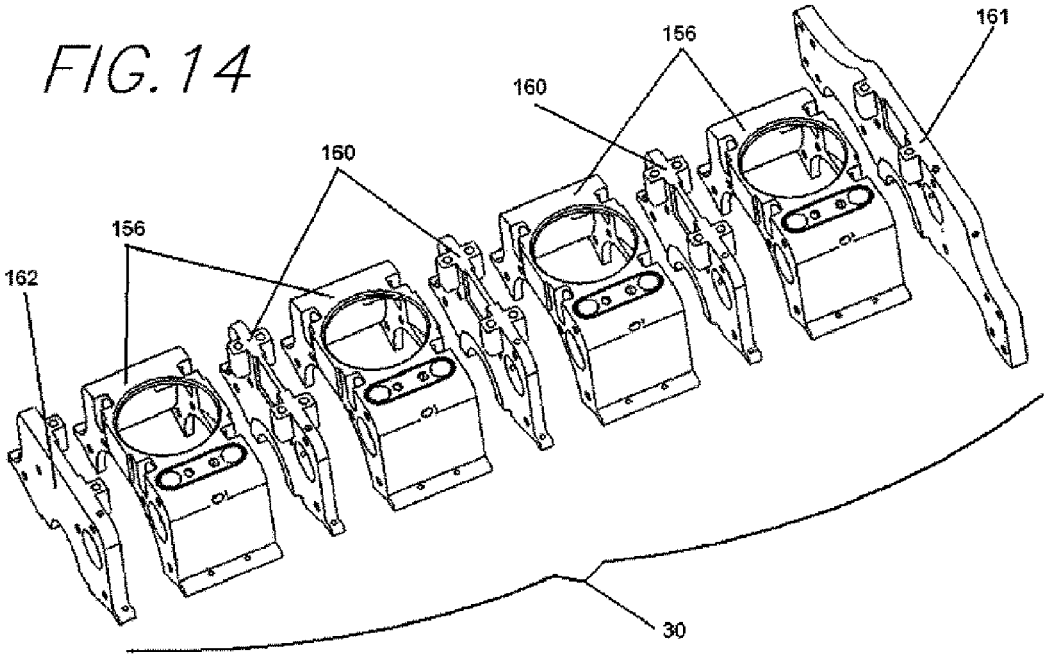
FIG. 14 is an exploded view of a modular cylinder carrier according to one aspect of the present invention.
Figure 15:
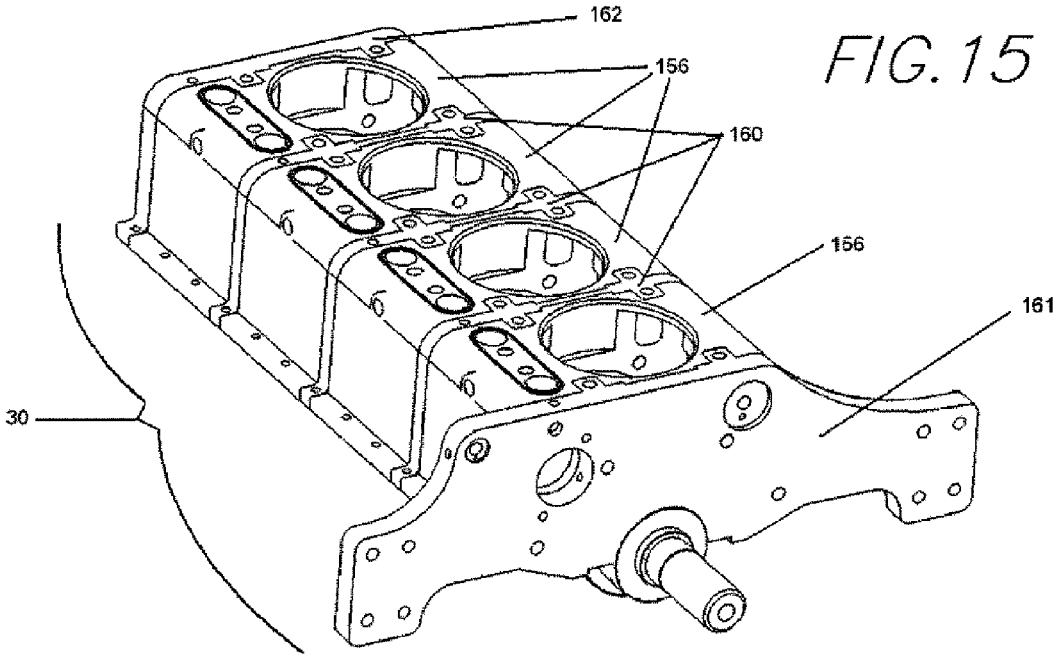
FIG. 15 illustrates the components of FIG. 14 after assembly into a modular engine carrier.

Details of the bottom end of the present engine are shown in FIGS. 11-15. The engines shown in FIGS. 11, 12 and 13 include a unitary cylinder carrier, 30, providing a base for a plurality of cylinder assemblies 16 (FIG. 13). FIGS. 14 and 15, on the other hand, show a modular cylinder carrier for a four-cylinder engine in which four separate mounting modules 156 are joined together by means of three main bearing bulkheads 160. Cylinder mounting modules 156 and bulkheads 160 are maintained in an assembly by means of threaded fasteners (not shown). FIG. 15 shows a completed cylinder carrier 30 which also includes an end bulkhead, 161, at the front of the engine. Bulkhead 161 has provisions for the front engine mounts. A rear bulkhead, 162, is provided for terminating the rear end of cylinder carrier 30. It is easily seen from FIGS. 14 and 15 that an engine according to the present invention may be assembled with varying numbers of cylinders merely by adding more or fewer cylinder mounting modules 156 and bulkheads 160.

Figure 11:
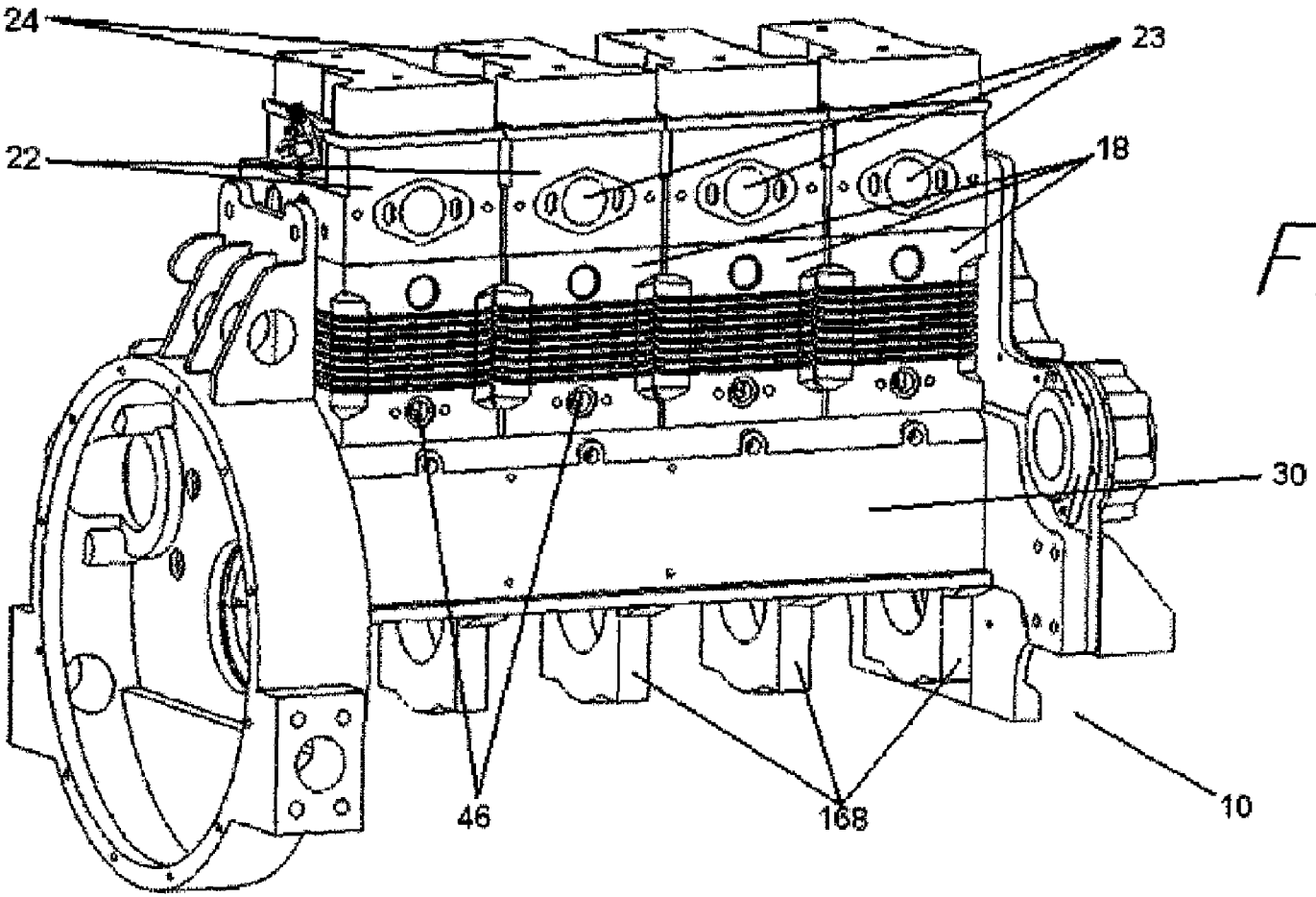
FIG. 11 illustrates placement of the main bearing caps in an engine according to the present invention.
Figure 12:
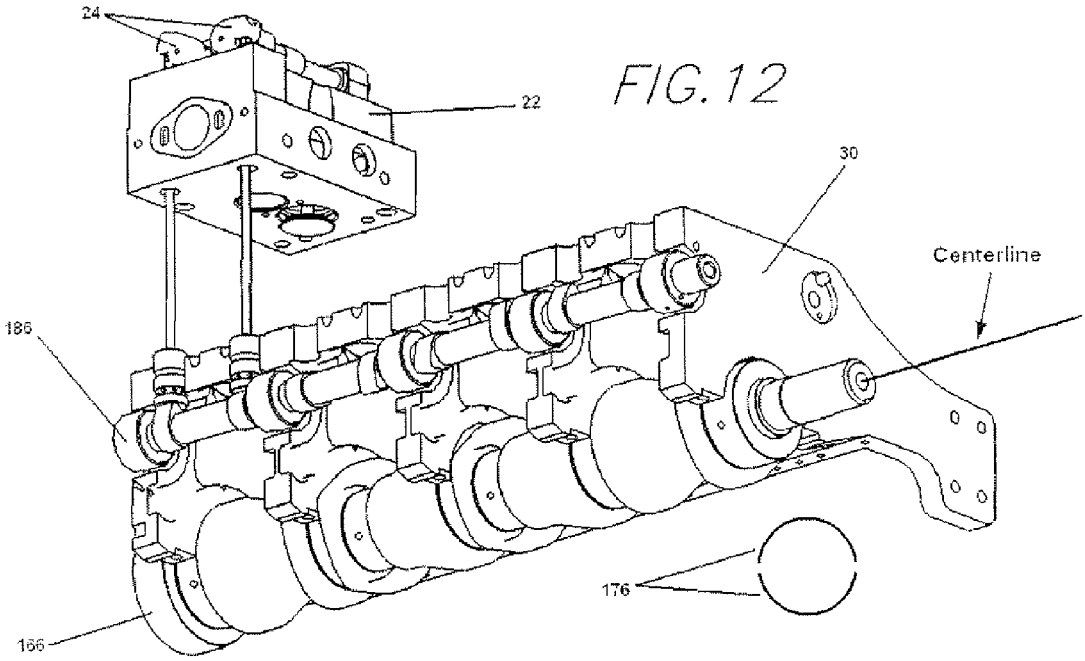
FIG. 12 illustrates placement of a crankshaft within an engine according to the present invention.

Regardless of the number of cylinders of engine 10, FIGS. 11 and 12 illustrate a feature providing for ready disassembly and repair of the present engine even when the engine is mounted within a watercraft, a motor vehicle, or another piece of machinery. Cylinder carrier 30, whether of a one-piece configuration as shown in FIGS. 11, 12 and 13, or in a modular configuration as shown in FIGS. 14 and 15, extends downwardly only to a position above the centerline of the crankshaft and main bearing bores. Thus, as shown in FIG. 12, inserts 176 for each of the main bearings of crankshaft 166 may readily be removed from engine 10 once the appropriate main bearing cap 168 (FIG. 11) has been removed.

Removal of main bearing inserts 176 is aided by the removability of structural rails 170 (FIG. 1). Structural rails 170 are used on both sides of engine 10. In addition to providing rigidity equal to or better than would be available with a deep skirt cylinder block, rails 170 allow ready access to fasteners for main bearing caps 168. After rails 170 have been removed from engine 10, as explained below, by removing the fasteners from oil pan 174, crankshaft bearings 176 are exposed, as may be visualized from FIGS. 11 and 12.

According to another aspect of the present invention, a method for replacing crankshaft main bearing inserts in a reciprocating internal combustion engine includes the steps of removing oil pan 174 and then removing structural rail 170 from at least one side of engine 10. Structural rail 170, oil pan 174, and cylinder carrier 30 are attached to another by means of through bolts 172 (FIG. 1) which extend through oil pan 174, and then through passages formed in structural rails 170, and into suitably tapped holes within carrier 30. Once structural rail 170 has been removed from the engine, main bearing caps 168 may be removed serially and the bearing inserts renewed using conventional techniques.

The present engine, whether having either a modular, or a non-modular cylinder carrier 30, permits ready removal and reinstallation of an individual cylinder assembly. Experience shows that frequently, only one cylinder of an engine may be worn excessively. All too often with mono-block engines, it becomes necessary to scrap the entire block because it is not possible to rebore the cylinder. Even if reboring is an option, in an engine application such as a pleasure boat, it is not possible to machine anything on the cylinder block without removing the engine from the boat. Such removal is extremely costly, and particularly so, in the case of boats having multiple decks above the engine room.

In contrast with prior art engines, with the present inventive engine it is possible to replace a cylinder assembly, including the piston, and, if necessary, the connecting rod, without removing the engine from a boat or other vehicle. Should removal of a marine variant of the present engine become necessary, however, the engine may be removed without the necessity of cutting an access hole in either the decks or hull of a boat, because once cylinder heads 22 and cylinder portions 18, as well as pistons 32, and connecting rods 40 have been removed from the engine, along with structural rails 170, oil pan 174, and crankshaft 166, the carrier 30 may be removed without the need for lifting equipment, which is generally unavailable belowdecks in most boats.

If it becomes necessary to remove and reinstall an individual cylinder assembly 16 of engine 10 according to the present invention, the steps for such removal and reinstallation include draining coolant from engine 10, removing a plurality of fasteners 172 extending from cylinder carrier 30 upwardly through cylinder portion 18 and cylinder head 22, and lifting cylinder head 22 and cylinder portion 18 from carrier 30. Then, wrist pin 36 may be slid within piston 32 sufficiently to allow piston 32 to be removed from connecting rod 40. Then a new piston, 32, is installed upon connecting rod 40. Thereafter, cylinder portion 18 may be slidably installed over piston 32 by sliding piston ring compression zone 178 (FIG. 6) over piston 32 and its piston rings. In essence, piston ring compression zone 178 makes it possible to reinsert pistons 32 into the bottom of cylinder bores 20 without the need of any additional ring compressor or other device. Also, it should be noted that with the exception of crankshaft 166, no machining is required to rebuild an engine according to the present invention.

While particular embodiments of the invention have been shown and described, numerous variations and alternate embodiments will occur to those skilled in the art. Accordingly, it is intended that the invention be limited only in terms of the appended claims.

What is claimed is:

1. A liquid-cooled internal combustion engine, comprising:

a plurality of cylinder assemblies mounted individually to a common cylinder carrier, with each cylinder assembly housing a single piston and having a cylinder portion, a cylinder head with at least one intake port, at least one exhaust port, and at least one self-contained cooling passage;

a coolant inlet manifold for introducing an individual coolant flow to each of said self-contained cooling passages; and an exhaust manifold assembly, mounted to each of said cylinder heads, with said exhaust manifold comprising a plurality of branch passages for receiving exhaust from each of said exhaust ports, and with said exhaust manifold further comprising a plurality of separate, generally annular intake coolant passages for conducting coolant flowing from each of said self-contained cooling passages about an exterior portion of a mating one of each of said branch passages.

2. A liquid-cooled internal combustion engine according to claim 1, wherein said at least one self-contained cooling passage for each cylinder assembly extends about said cylinder portion and said cylinder head, with said coolant passage discharging into said exhaust manifold assembly at a location proximate said exhaust port.

3. A liquid-cooled internal combustion engine according to claim 1, wherein said coolant inlet manifold introduces an individual coolant flow to each of said self-contained cooling passages at a location proximate a lower portion of each of said cylinder portions, such that coolant is first permitted to flow about said cylinder portion and then about said cylinder head prior to being discharged into said exhaust manifold.

4. A liquid-cooled internal combustion engine according to claim 1, wherein said exhaust manifold further comprises a heat exchanger for transferring heat from coolant flowing from said cylinder assemblies.

5. A liquid-cooled internal combustion engine according to claim 1, further comprising a liquid-cooled charge air intercooler and a pump for furnishing raw water directly to said intercooler.

6. A liquid-cooled internal combustion engine according to claim 1, further comprising a liquid-cooled engine oil cooler and a pump for furnishing raw water directly to said oil cooler.

7. A liquid-cooled internal combustion engine according to claim 1, wherein said exhaust manifold further comprises a heat exchanger for transferring heat from coolant flowing from said cylinder assemblies to raw water flowing directly through said heat exchanger from a raw water pump.

8. A liquid-cooled internal combustion engine according to claim 5, further comprising a secondary fluid cooler, located downstream from said intercooler, for transferring heat from a secondary fluid to the raw water flowing from said intercooler.

9. A liquid-cooled internal combustion engine according to claim 6, further comprising a turbocharger having a cooling jacket for receiving raw water flowing from said oil cooler.

10. A multi-cylinder internal combustion engine having a hybrid cooling system, comprising:

a plurality of cylinder assemblies mounted individually to a common cylinder carrier, with each cylinder assembly housing a single piston and having a cylinder portion with a cylinder bore, and a cylinder head with at least one intake port, and at least one exhaust port, and with a self-contained cooling passage extending about said cylinder portion and said cylinder head;

a coolant inlet manifold for introducing an individual fresh water coolant flow to each of said self-contained cooling passages at a location proximate a lower portion of each of said cylinder assemblies;

an exhaust manifold assembly, mounted to each of said cylinder heads, with said exhaust manifold comprising a plurality of branch passages for receiving exhaust from each of said exhaust ports, and with said exhaust manifold further comprising a plurality of separate coolant intake passages for conducting coolant flowing from each of said self-contained cooling passages about an exterior portion of a mating one of each of said branch passages, and with said exhaust manifold further comprising a raw water cooled heat exchanger for extracting heat from fresh water circulating through said exhaust manifold heat exchanger;

an exhaust driven turbocharger operatively connected to said exhaust manifold; and an intake manifold for receiving air from said turbocharger, with said intake manifold comprising a charge air intercooler cooled by raw water.

11. A liquid-cooled internal combustion engine according to claim 10, wherein said charge air intercooler is cooled by a direct raw water flow.

12. A liquid-cooled internal combustion engine according to claim 10, wherein said raw water cooled heat exchanger is cooled by a direct raw water flow.

13. An internal combustion engine according to claim 10, further comprising at least one fuel injector mounted to each of said cylinder heads.

14. An internal combustion engine according to claim 10, wherein said, at least one fuel injector comprises a diesel fuel injector.

15. An internal combustion engine according to claim 10, wherein said at least one fuel injector comprises a gasoline injector.

16. An internal combustion engine according to claim 10, wherein said at least one fuel injector comprises a natural gas injector.

17. An internal combustion engine according to claim 10, wherein said at least one fuel injector comprises a nitrous oxide injector.

18. A method for cooling a multi-cylinder internal combustion engine, comprising the steps of:

cooling a plurality of cylinder assemblies by providing an individual flow of fresh water to each of a plurality of discrete cooling passages, with a discrete one of such passages being routed through each of said cylinder assemblies;

extracting heat from the fresh water flowing from the cylinder assemblies, by means of a direct raw water cooled heat exchanger; and extracting heat from a charge air intercooler by providing a direct raw water flow to said intercooler.

19. A method according to claim 18, further comprising the step of extracting heat from lubricating oil flowing through the engine, by means of a heat exchanger cooled by a direct raw water flow.

* * * * *